United States Patent [19]

Gigliotti, Jr. et al.

[11] Patent Number: 4,788,035

[45] Date of Patent: Nov. 29, 1988

[54] TRI-TITANIUM ALUMINIDE BASE ALLOYS OF IMPROVED STRENGTH AND DUCTILITY

[75] Inventors: Michael F. X. Gigliotti, Jr., Scotia, N.Y.; Brian J. Marquardt, Cincinnati, Ohio

[73] Assignee: General Electric Company, Schenectady, N.Y.

[21] Appl. No.: 56,515

[22] Filed: Jun. 1, 1987

[51] Int. Cl.[4] ..... C22C 14/00

[52] U.S. Cl. ..... 420/420; 148/421; 420/418

[58] Field of Search ..... 420/418, 419, 420; 148/11.5 F, 407, 421

[56] References Cited

U.S. PATENT DOCUMENTS

| | | | |
|---|---|---|---|
| 2,880,088 | 3/1959 | Jaffee et al. | 420/418 |
| 2,892,705 | 6/1959 | Jaffee et al. | 420/420 |
| 4,294,615 | 10/1981 | Blackburn et al. | 420/420 |
| 4,661,316 | 4/1987 | Hashimoto et al. | 420/418 |

FOREIGN PATENT DOCUMENTS

| | | | |
|---|---|---|---|
| 2060693 | 5/1981 | United Kingdom | 420/418 |

*Primary Examiner*—L. Dewayne Rutledge
*Assistant Examiner*—Robert L. McDowell
*Attorney, Agent, or Firm*—Paul E. Rochford; James C. Davis, Jr.; James Magee, Jr.

[57] ABSTRACT

A titanium aluminide base composition is provided which has increased tensile strength, ductility and rupture life due to the addition of tantalum coupled with optional additions of vanadium and columbium.

3 Claims, No Drawings

TRI-TITANIUM ALUMINIDE BASE ALLOYS OF IMPROVED STRENGTH AND DUCTILITY

The present invention relates to $Ti_3Al$, titanium aluminide, base alloys which contain refractory metal additions and which have resultant improved strength and ductility. More specifically it relates to tri-titanium aluminide base alloys containing vanadium, tantalum and mixtures of vanadium and tantalum with each other and with columbium, hafnium or tungsten. Our discovery is based on the finding that certain alloying elements form a strong and ductile second phase in alloys having a $Ti_3Al$ base.

PRIOR ART

Considerable prior art exists in the study of $Ti_3Al$ which is properly designated as tri-titanium aluminide, but which is referred to hereafter as titanium aluminide with the understanding that the titanium aluminide designates $Ti_3Al$ and alloys having a $Ti_3Al$ base.

Early attempts to develop high strength titanium alloys included studies of alloys whose major constituent would have been $Ti_3Al$. The United States Air Force, Wright-Patterson Air Force Base, Ohio, published reports by McAndrew and Simcoe entitled "Investigation of the Ti—Al—Cb System as a Source of Alloys for Use at 1200°-1800° F.", number WADD Technical Report 60-99, and "Development of Ti—Al—Cb Alloy for Use at 1200°-1800° F.", numbers ASD TR 61-446, Part I and Part II. These reports summarized research in the Ti—Al—Cb system from 5 to 17.5 weight % Al from 15 to 30 weight % Cb. In atomic percent these compositions are approximately from 9 to 30 atomic % Al and 8 to 17 atomic % Cb. These compositions would yield alloys having as a major constituent $Ti_3Al$. At high Cb levels these alloys also have a body centered cubic beta phase. After an initial screening of a wide range of compositions, McAndrew and Simcoe evaluated in more detail compositions around Ti—12.5 weight % Al—22.5 weight % Cb (Ti—22.5 atomic % Al—11.8 atomic % Cb) and additions of Zr, Hf, Sn, B, and C. Their overall conclusions were that the Ti—Al—Cb system had excellent rupture strength and oxidation resistance, but had disadvantages of low room temperature ductility and high creep rates.

Blackburn, Ruckle and Bevan described a study of alloy additions of $Ti_3Al$ in "Research to Conduct an Exploratory Experimental and Analytical Investigation of Alloys", report AFML-TR-78-18, published by the United States Air Force, Wright-Patterson Air Force Base, Ohio in 1978. This work comprised an initial survey making small heats with ternary additions to $Ti_3Al$ of Sc, Cu, Ni, Ge, Ag, Bi, Sb, Fe, W, Ta, Be, Cb and Zr. The level of the additions of Ta was 1 atomic % and the level of Cb additions was 8, 11 and 15 atomic %. Four and five element additions were surveyed where the base was $Ti_3Al$ containing Cb. Other additions were surveyed where the base was $Ti_3Al$ containing Cb and the additions to the Ti—Al—Cb alloy included 1 atomic % V and 1 atomic % Ta. More detailed studies were conducted on selected compositions. The alloys Ti—24 atomic % Al—11 atomic % Cb and Ti—25 atomic % Al—15 atomic % Cb had good combinations of low temperature ductility and high temperature creep resistance, and the study concluded that the ternary Ti—Al—Cb system was the best system for achieving desired properties.

Rhodes, Hamilton and Paton evaluated titanium aluminide alloys in the Ti—Al—Cb system and single element additions to this system, described in "Titanium Aluminides for Elevated Temperature Applications", report AFML-TR-78-130, published by the United States Air Force, Wright-Patterson Air Force Base, Ohio in 1978. Additions up to 5.6 atomic % V were studied but the 5.6 atomic % V alloy had only 2 atomic % Cb. This was the only alloy studied with vanadium above 4 atomic %. It had a total of (Cb+V) atomic % less than 10 and had poor room temperature ductility. The alloy Ti—27 atomic % Al—8.2 atomic % Cb—2 atomic % V was found to have good room temperature bend ductility. Processing studies such as superplastic forming and diffusion bonding were carried out on the composition Ti—24 atomic % Al—11 atomic % Cb.

The level of vanadium substitution for columbium was investigated in work reported by Blackburn and Smith, "Research to Conduct an Exploratory Experimental and Analytical Investigation of Alloys", report AFWAL-TR-80-4175, published by the United States Air Force, Wright-Patterson Air Force Base, Ohio in 1980. The alloys Ti—25 atomic % Al—14 atomic % Cb; Ti—25 atomic % Al—10 atomic % Cb—4 atomic % V; and Ti—24.5 atomic % Al—13 atomic % Cb were investigated. The alloy with vanadium had slightly lower rupture life and tensile ductility. Blackburn and Smith described more detailed evaluation of $Ti_3Al$ alloys in "Research to Conduct an Exploratory Experiment and Analytical Investigation of Alloys", report AFWAL-TW-81-4046, published by the United States Air Force, Wright-Patterson Air Force Base, Ohio in 1981. Ti—Al—Cb alloys with additions of Hf, Si, Zr+Sn+C, and V were evaluated. The base alloy used for most additions and for processing studies was Ti—24 atomic % Al—11 atomic % Cb. The alloy Ti—25 atomic % Al—9 atomic % Cb—2 atomic % V was noted to have desirable strength and ductility. No levels of vanadium higher than 2 atomic % were investigated.

In U.S. Pat. No. 4,292,077, "Titanium Alloys of the $Ti_3Al$ Type", Blackburn and Smith identify 24-27 atomic % aluminum and 11-16 atomic percent columbium as the preferred composition range. High aluminum increases strength but hurts ductility, high columbium increases ductility but hurts high temperature strength. Vanadium is identified as being able to be substituted for columbium up to about 4 atomic %.

Additional modification of the $Ti_3Al$ alloys was studied by Blackburn and Smith where molybdenum was substituted for some columbium and vanadium in the alloy Ti—25 atomic % Al—10 atomic % Cb—3 atomic % V—1 atomic % Mo. This work was reported as "R & D on Composition and Processing of Titanium Aluminide Alloys for Turbine Engines", report number AFWAL-TR-82-4086, published by the United States Air Force, Wright-Patterson Air Force Base, Ohio in 1981.

In all of these previous works, columbium additions around 10 atomic % were shown to improve the ductility of titanium aluminide alloys. Neither tantalum nor vanadium was recognized as functionally equivalent or superior to columbium, with respect to improving low temperature ductility and high temperature strength, although vanadium was thought to be an element which could, within strict limits, substitute for columbium, up to a level of about 4 atomic %. From the work conducted and reported, there is no recognition that high levels of vanadium or tantalum could stand on their own as ductilizing agents for $Ti_3Al$. Tantalum was not investigated above the 1 atomic % level, and no trend in improved strength or ductility with tantalum was recognized. Vanadium was added as a substitute for columbium, but only at low levels of addition or where the sum of vanadium plus columbium was too low to yield an alloy with good ductility.

BRIEF STATEMENT OF THE INVENTION

It is accordingly one object of the present invention to provide titanium aluminide base compositions which have improved tensile strength and ductility.

Another object is to provide titanium aluminide base compositions which have greater tensile strength and ductility than the prior art titanium-aluminum-columbium compositions.

Another object is to provide a method by which the tensile strength and ductility improvements of titanium aluminide base compositions may be obtained.

Another object is to provide titanium aluminide intermetallic alloys based on $Ti_3Al$ which have improved tensile strength and ductility when alloyed with vanadium, tantalum and mixtures of these elements with hafnium and tungsten.

Other objects will be in part apparent and in part apparent from the description which follows.

In one of its broader aspects an object of the present invention may be achieved by preparing a titanium aluminide base compositions containing additions of vanadium, columbium and tantalum according to the following prescription. For good creep resistance the alloy should contain no less than 2 atomic % tantalum. Further, for such good creep resistance the alloy should contain no more than 5 atomic % of either vanadium or columbium. Further, the sum of the atomic percents of tantalum, columbium and vanadium should exceed 5%.

In another of its broad aspects a composition with high tensile elongations in excess of 5% at 260° C. can be obtained by preparing a titanium aluminide base composition containing in excess of 2.5 atomic % columbium in addition to the prescriptions set forth above.

In one of its preferred aspects of the object of the invention can be accomplished by preparing an alloy composition having a titanium aluminide base and containing between 6 and 7.5 atomic % tantalum, between 2.5 and 4 atomic % columbium and between 0.5 and 1.5 atomic % vanadium.

DETAILED DESCRIPTION OF THE INVENTION

We have discovered that titanium aluminide intermetallic alloys based on $Ti_3Al$ have improved tensile strength and ductility when alloyed with vanadium, tantalum and mixtures of these elements with columbium and also with columbium including hafnium and tungsten. We made this discovery while seeking alloying elements which would form a strong and ductile second phase in alloys based on $Ti_3Al$.

A principal discovery is that vanadium and tantalum additions to $Ti_3Al$ produce alloys which have good combinations of tensile strength and ductility. What we have also discovered is that vanadium or tantalum additions can be combined with each other and also that such additions can be combined with columbium and other elements to also yield alloys with desirable tensile strengths and ductilities as more fully set forth below.

EXAMPLES 1—12

A number of alloy compositions were prepared by first non-consummably arc melting the alloy constituents into buttons. The bottons are in essence relatively small samples formed from the melting of the alloy constituents.

The buttons were press forged at 900° C. The alloys were then heat treated according to procedure "N" at 1150° C. for 1 hour followed by heating at 815° C. for 1 hour. Alternatively samples were heat treated according to procedure "N'" at 1162° C. for 1 hour followed by heating at 760° C. for 1 hour.

The heat treated pieces were machined into tensile bars of conventional form for tensile and creep rupture testing. The tensile test were conducted at 260° C. (500° F.). and at 650° C. (1202° F.). Creep rupture tests were conducted in air at 650° C. and at a stress of 55 ksi. The compositions of the buttons are listed in Table I.

TABLE I

| | $Ti_3Al$ Alloys Compositions in atomic % | | | | | | | |
|---|---|---|---|---|---|---|---|---|
| Example | Ti | Al | V | Cb | Ta | Hf | Cr | W |
| 1 | 64.56 | 24.69 | — | 10.75 | — | — | — | — |
| 2 | 67.50 | 22.50 | — | 10.00 | — | — | — | — |
| 3 | 68.83 | 23.75 | 5.00 | — | — | — | — | — |
| 4 | 67.50 | 22.50 | 10.00 | — | — | — | — | — |
| 5 | 68.83 | 23.75 | — | — | 5.00 | — | — | — |
| 6 | 67.50 | 22.50 | — | — | 10.00 | — | — | — |
| 7 | 67.50 | 22.50 | 5.00 | 5.00 | — | — | — | — |
| 8 | 67.50 | 22.50 | — | 5.00 | 5.00 | — | — | — |
| 9 | 67.50 | 22.50 | — | 3.00 | 7.00 | — | — | — |
| 10 | 67.50 | 22.50 | 5.00 | — | 5.00 | — | — | — |
| 11 | 68.25 | 22.75 | 3.00 | 3.00 | 3.00 | — | — | — |
| 12 | 64.25 | 22.75 | 3.00 | 3.00 | 3.00 | 3.00 | — | 1.00 |

Table I lists compositions based on $Ti_3Al$ which were evaluated in tensile and creep tests.

Example 1 is a state of the art alloy, similar to that studied in the prior art work cited above.

The alloy of Example 2 is a similar alloy in which the columbium content has been reduced to 10 atomic % and the aluminum reduced to 22.5 atomic %, in effect $Ti_3Al$ composition diluted by 10 atomic % columbium. Example 2 will serve as a precise basis of comparison for the other alloys.

What has been discovered is that vanadium and tantalum additions to $Ti_3Al$ produce alloys with good low temperature ductility and high temperature strength. For high temperature alloys it is desirable to have higher strength at the lower temperatures. This is because strength usually decreases as the temperature of an alloy is raised, and the ductility usually increases as the temperature is raised. An alloy which has good ductility at lower temperatures and good strength at higher temperatures is therefore highly desirable.

We have discovered that vanadium or tantalum additions can be combined with each other or with columbium or other elements to yield alloys with good properties as will be described with respect to the alloy examples below. Further, it has been discovered that high tantalum alloys combined good low temperature ductilities and high temperature strengths with creep resistance that is superior to the state of the art columbium alloys represented by the alloys of Examples 1 and 2.

Examples 3 and 4 provided a $Ti_3Al$ alloy to which 5 and 10 atomic % vanadium have been added. The alloy of Example 4 serves as a basis for direct comparison to the state of the art alloys of Example 2 as to the effect of additions of vanadium compared to columbium.

The alloys of Examples 5 and 6 are $Ti_3Al$ base alloys to which 5 and 10 atomic % tantalum have been added. The alloy of Example 6 serves as a basis for direct comparison to the state of the art alloys of Example 2 as to the effect of the addition of tantalum as compared to the addition of columbium.

The alloys of Examples 7 through 10 involve binary additions of (V+Cb), (Ta+Cb), and (V+Ta) to a $Ti_3Al$ alloy base where the sum addition for each binary combination is 10 atomic %. The alloy of Example 7 involves the addition of 5 atomic % each of V and Cb. The alloy of Example 8 involves the addition of 5 atomic % each of Ta and Cb. The alloy of Example 9 involves the addition of 7 atomic % Ta and 3 atomic % Cb. The alloy of Example 10 involves the addition of 5 atomic % each of V and Ta.

The alloys of Examples 11 and 12 relate to ternary and quaternary additions to $Ti_3Al$. The alloy of Example 11 involves the addition of 3 atomic % each of V, Ta, and Cb. The alloy of Example 12 involves the addition of 3 atomic % each of Hf, V, Ta, and Cb, and 1 atomic % W. As indicated above a series of tests were conducted on these alloys to determine tensile and ductility properties. The results which were obtained from these tensile and ductility tests are set forth in Table II below.

TABLE II

Tensile Tests of $Ti_3Al$ Alloy Forgings

| Example | Alloy additive | HT | Temp. | .2% Y.S. | U.T.S. | % Tensile Elongation | % Reduction area |
|---|---|---|---|---|---|---|---|
| 1 | 10.75 | N | 260 C. | 60.0 | 79.8 | 5.4 | 6.0 |
| 1 | Cb | N | 650 C. | 42.4 | 55.6 | 38.7 | 42.0 |
| 2 | 10Cb | N | 260 C. | 70.4 | 110.2 | 22.3 | 20.0 |
| 2 | | N' | 260 C. | 50.6 | 64.2 | 16.0 | 16.5 |
| 2 | | N | 650 C. | 50.6 | 64.2 | 16.0 | 18.0 |
| 2 | | N' | 650 C. | 63.1 | 79.9 | 10.9 | 12.2 |
| 3 | 5V | N' | 260 C. | 117.6 | 133.7 | 1.3 | 4.8 |
| 3 | | N' | 650 C. | 74.8 | 90.7 | 11.0 | 11.0 |
| 4 | 10V | N | 260 C. | 110.2 | 140.8 | 2.2 | 4.1 |
| 4 | | N | 650 C. | 84.1 | 99.1 | 5.2 | 6.1 |
| 5 | 5Ta | N' | 260 C. | 120.0 | 132.2 | 1.6 | 4.0 |
| 5 | | N' | 650 C. | 84.5 | 104.4 | 7.5 | 9.9 |
| 6 | 10Ta | N | 260 C. | 146.9 | 165.7 | 2.7 | 4.1 |
| 6 | | N | 650 C. | 99.0 | 114.9 | 5.2 | 6.1 |
| 7 | 5V—5Cb | N | 260 C. | 108.2 | 138.4 | 6.0 | 4.1 |
| 7 | | N | 650 C. | 70.4 | 86.3 | 10.7 | 10.2 |
| 8 | 5Ta—5Cb | N | 260 C. | 82.7 | 120.2 | 13.1 | 14.3 |
| 8 | | N | 650 C. | 58.8 | 74.1 | 21.5 | 16.3 |
| 9 | 7Ta—3Cb | N' | 260 C. | 118.3 | 150.5 | 6.4 | 9.6 |
| 9 | | N' | 650 C. | 92.3 | 109.4 | 3.4 | 6.1 |
| 10 | 5V—5Ta | N' | 260 C. | 157.8 | 180.3 | 3.4 | 7.2 |
| 10 | | N' | 650 C. | 115.6 | 135.8 | 3.4 | 5.4 |
| 11 | 3V—3Ta—3Cb | N | 260 C. | 103.1 | 132.7 | 6.7 | 6.1 |
| 11 | | N | 650 C. | 77.1 | 92.7 | 7.2 | 10.2 |
| 12 | 3V—3Ta—3Cb—3Hf—1W | N | 260 C. | 136.0 | 175.6 | 8.0 | 8.0 |
| 12 | | N | 650 C. | 108.6 | 124.4 | 2.4 | 4.1 |

Heat Treatment Code:

N=Heat at 1150° C. for 1 hour, quench in cool flowing helium gas; reheat to 815° C. for 1 hour and cool in outer water cooled chamber of the furnace N'=Heat at 1162° C. for 1 hour, quench in cool flowing helium gas; reheat to 760° C. for 1 hour and cool in outer heater cooled chamber of the furnace Please note with regard to Table II above that there is a subscript indicating that the heat treatment N was at 1150° C. for 1 hour and 815° C. for 1 hour whereas the heat treatment N' was at 1162° C. for 1 hour and 760° C. for 1 hour. Also please note from the listings in Table II there are results listed for the study of the base composition of Example 2 at both the N heat treatment of 1150° C. for 1 hour and 815° C. for 1 hour and also at the N' heat treatment of 1162° for 1 hour and 760° C. for 1 hour at both testing temperatures of 260° C. and at 650° C.

From the result obtained and listed in Table II it is evident that the vanadium and tantalum containing alloys compare very favorably with the baseline alloys of Examples 1 and 2.

Further it is noteworthy that the alloy of Example 5, which contained 5% tantalum, has a lower ductility and loer strength than the alloy of Example 6, which contained 10% tantalum. Similarly, the alloy of Example 3, which contained 5% vanadium, has lower strength and ductility than the alloy of Example 4, which contained 10% vanadium. Based on the results, additions at the 10 atomic % level are preferred for both the vanadium and the tantalum.

For alloy additives which are added at the 10% level it will be noted, for the alloys of Examples 4 and 6, that these alloys have significantly higher tensile strengths than the baseline alloys of Examples 1 and 2. Also it is noteworthy that the alloys of Examples 4 and 6 are characterized by good ductilities along with the higher tensile strengths.

Further it is noteworthy that the alloys containing two element additions selected from the group consisting of tantalum, vanadium and columbium and more specifically the alloys of Examples 7, 8, 9 and 10 all exhibit higher tensile strengths than the baseline alloys of the Examples 1 and 2.

For those samples which have more than two elements added, or in other words for the multi-element addition, as for example with respect to Examples 11 and 12, it will be observed that all the alloys of these examples exhibit higher strengths than the baseline alloy.

It will further be observed from the results listed in Table II that the highest tensile strengths are achieved in the alloys which contain the highest level of tantalum. The alloy of Example 9, which contains 7 atomic % tantalum, 3 atomic % columbium and the alloy of Example 10, which contains 5 atomic % tantalum and 5 atomic % vanadium, achieve a good balance of ductility and strength.

In terms of obtaining good strength and ductility the composition range for the three elements, tantalum, vanadium and columbium, is found from the study made and results obtained and listed in Table II to be about 5 to 10 atomic % tantalum, 0 to 5 atomic % vanadium and 0 to 5 atomic % columbium.

Tests were made of the creep and rupture properties of the compositions prepared as listed in Table I. The results of these tests which were conducted by standard testing procedures are listed in Table III.

TABLE III

Results of Creep Tests at 650° C. and 55 ksi Stress in Air

| Test Alloy of Example | Alloy Additive | HT | Creep Life Hours to: 2% Creep | 4% Creep | Rupture | Minimum Creep Rate %/hr. |
|---|---|---|---|---|---|---|
| 1 | 10.75Cb | N' | 1.7 | 6.5 | 23.45 | 0.3 |
| 2 | 10Cb | N' | 1.15 | 3.8 | 4.91 | 0.7 |
| 4 | 10V | N | .67 | 1.6 | 5.39 | 2.0 |
| 6 | 10Ta | N | 11.5 | >24 | 24.86 | 0.088 |
| 7 | 5V—5Cb | N | .7 | 1.8 | 4.04 | 1.7 |
| 8 | 5Ta—5Cb | N | .7 | 2.2 | 6.89 | 1.2 |
| 9 | 7Ta—3Cb | N' | 4.1 | 12.7 | 14.85 | 0.23 |
| 11 | 3Ta—3V—3Cb | N | 3.75 | 8.3 | 8.57 | 0.32 |
| 12 | 11+3Hf—1W | N | 3.45 | 10.7 | 14.99 | 0.24 |

Heat Treatment Code:

N=Heat at 1150° C. for 1 hour, quench in cool flowing helium gas; reheat to 815° C. for 1 hour and cool in an outer water cooled chamber of the furnace N'=Heat at 1162° C. for 1 hour, quench in cool flowing helium gas; reheat to 760° C. for 1 hour and cool in an outer water cooled chamber of the furnace It was found as is evident from the Table that the high tantalum alloys have the best creep resistance. The alloy which was found to have the lowest creep rate and longest times to 2% creep and rupture was the alloy of Example 6 which contained 10 atomic % tantalum. Based on the results obtained a listing is made of the respective alloys according to their respective properties. The alloys which are most resistant are listed at the top and the alloys which are least resistant are listed at the bottom for three different property measurements. The three different property measurements are specifically minimum creep rate, time to 2% creep and rupture life. The date relating to these measurements is presented in Table IV below.

TABLE IV

Comparative Listing of Binary and Ternary and Etc. $Ti_3Al$ Base Alloys on the Basis of Relative Creep Resistance*

| | Minimum Creep Rate | Time to 2% Creep | Time to Rupture |
|---|---|---|---|
| Most Creep Resistant | 10Ta (Ex. 6) | 10Ta (Ex. 6) | 10Ta (Ex. 6) |
| | 7Ta—3Cb (Ex. 9) | 7Ta—3Cb (Ex. 9) | 3Ta—3V—3Cb—3Hf—1W (Ex. 12) |
| | 3Ta—3V—3Cb—3Hf—1W (Ex. 12) | 3—Ta—3V—3Cb (Ex. 11) | 7Ta—3Cb (Ex. 9) |
| | 3—Ta—3V—3Cb (Ex. 11) | 3Ta—3V—3Cb—3Hf—1W (Ex. 12) | 3Ta—3V—3Cb (Ex. 11) |
| | 10Cb (Ex. 2) | 10Cb (Ex. 2) | 5Ta—5Cb (Ex. 8) |
| | 5Ta—5Cb (Ex. 8) | 5Ta—5Cb (Ex. 8) | 10V (Ex. 4) |
| | 5V—5Cb (Ex. 7) | 5V—5Cb (Ex. 7) | 10Cb (Ex. 2) |
| Least Creep Resistnt | 10V (Ex. 4) | 10V (Ex. 4) | 5V—5Cb (Ex. 7) |

*Example 1 excluded because of higher aluminum content.

From a review of the Table III content and the constituents of the respective alloys it is our finding that the high tantalum alloys are the most creep resistant. This is followed in relative creep resistance by the alloys of Example 11 and 12, the alloys having three element additions and the alloys having five element additions, respectively. One of the baseline alloys, and specifically the baseline alloy of Example 1, had relatively good creep resistance, but this alloy had a higher aluminum content than the other alloys. The cited prior art articles show that aluminum content has a very strong effect on creep strength. The second base alloy, namely that of Example 2, also listed in Table I, has an aluminum level similar to the level of the other alloys listed in Table I and is the better alloy with which to compare and measure the creep resistance in the "state of the art" alloying of compositions with high levels of columbium. This second base alloy provides a better standard to be compared with the alloys of the other examples.

From a consideration of creep resistance, alloying addition level ranges preferably include the ternary alloy type of Example 11. This alloy of Example 11 contained 3 atomic % each of tantalum, columbium and vanadium. From the results obtained it is our belief that similar results are obtainable with alloy variations at the same level of tantalum or at increasing levels of tantalum.

The good creep resistance of the alloys of Example 12 indicates that other elements such as hafnium and tungsten can be added for further strengthing of the alloy itself.

Based on the foregoing and based on considerations of good tensile strengths and ductilities and high creep resistances a preferred alloy range can be defined for the additions of vanadium, columbium and tantalum. For good creep resistance the alloy should contain no less than about 3 atomic % tantalum and at the same time no more than about 5 atomic % of either vanadium or columbium. Further for the same composition the sum of the atomic percents of tantalum plus columbium plus vanadium should exceed 5%. This tantalum-containing composition as defined immediately above is a preferred composition and range of compositions for good tensile strength, good ductility and high creep resistance.

Also, based on the data of the above examples tensile elongations in excess of 5% at 260° C. were observed for alloys containing 3 or more atomic % columbium. Accordingly a further specification of columbium as being in excess of 2.5 atomic % defines a composition range of still higher preference.

The composition range which is most preferred for the best overall combination of properties is one containing between 6 and 7.5 atomic % tantalum, 2.5 and 4 atomic % columbium and 0 to 1.5 atomic % vanadium.

The composition range of stability of $Ti_3Al$ phase is very broad, and alloys containing aluminum contents from about 20 atomic % to 30 atomic % aluminum could be used as bases to which the elements tantalum, vanadium, and columbium would be added. Further, Example 12 demonstrates that strengthening by other elements such as hafnium and tungsten is not incompatible with the effect obtained by the tantalum, vanadium, and columbium additions. Since zirconium behaves like hafnium in its alloying behavior with titanium; molybdenum behaves like tungsten in its alloying behavior with titanium; tin, indium and gallium behave like aluminum in forming a $Ti_3X$ phase, where X is Sn, In, or Ga, of the same crystal structure as $Ti_3Al$; and elements such as Si and Ge would be expected to have the same beneficial strain aging characteristics in the hexagonal $Ti_3Al$ phase as they do in hexagonal Ti solid solutions, these named elements can be made to the base alloy or substituted for the elements whose behavior they imitate or enhance and can comprise part of a $Ti_3Al$ base alloy to which the tantalum, vanadium, and columbium additions would be made. These elements may be added to $Ti_3Al$ base as substituent additives for aluminum, titanium, hafnium and tungsten in the novel alloys of this invention.

What is claimed is:

1. A composition having a titanium aluminide base and having good tensile strengths and ductilities and high creep resistance which comprises a composition containing a matrix phase based on $Ti_3Al$ and containing additions of vanadium, columbium and tantalum wherein the additions are in the following proportions:

(a) no less than about 2 atomic % tantalum;

(b) no more than about 5 atomic % of either vanadium or columbium;

(c) the sum of atomic % tantalum, columbium and vanadium exceeding 5%.

2. The composition of claim 1 in which tensile elongation is in excess of 5% at 260° C. and wherein the tantalum is present to the extent of 2 to 7.5 atomic % and the columbium is present to the extent of 2.5 to 5 atomic %.

3. A titanium aluminide composition containing 20–26 atomic % aluminum, 6 to 7.5 atomic % tantalum, 2.5 to 4 atomic percent columbium and 0 to 1.5 atomic % vanadium and the balance titanium.

* * * * *